US010027052B2

(12) United States Patent
Yudate

(10) Patent No.: US 10,027,052 B2
(45) Date of Patent: Jul. 17, 2018

(54) WATERPROOF CONNECTION APPARATUS FOR ELECTRONIC EQUIPMENT, AND ELECTRONIC EQUIPMENT

(71) Applicant: EX Company Limited, Matsuyama-shi, Ehime (JP)

(72) Inventor: Shinya Yudate, Matsuyama (JP)

(73) Assignee: EX COMPANY LIMITED, Matsuyama-Shi (JP)

( * ) Notice: Subject to any disclaimer, the term of this patent is extended or adjusted under 35 U.S.C. 154(b) by 0 days.

(21) Appl. No.: 15/309,943

(22) PCT Filed: May 11, 2015

(86) PCT No.: PCT/JP2015/002380
§ 371 (c)(1),
(2) Date: Nov. 9, 2016

(87) PCT Pub. No.: WO2015/182049
PCT Pub. Date: Dec. 3, 2015

(65) Prior Publication Data

US 2017/0250495 A1 Aug. 31, 2017

(30) Foreign Application Priority Data

May 26, 2014 (JP) ..... 2014-108087

(51) Int. Cl.
*H01R 13/40* (2006.01)
*H01R 13/52* (2006.01)
(Continued)

(52) U.S. Cl.
CPC ..... *H01R 13/5202* (2013.01); *H01R 24/66* (2013.01); *H01R 2107/00* (2013.01)

(58) Field of Classification Search
CPC . H01R 2107/00; H01R 24/66; H01R 13/5202
(Continued)

(56) References Cited

U.S. PATENT DOCUMENTS 5,284,448 A 2/1994 Hussmann et al.
6,623,299 B1 * 9/2003 Liu ..... H01R 13/5845 439/587
(Continued)

FOREIGN PATENT DOCUMENTS

CN 202585914 U 12/2012
JP 05-258801 10/1993
(Continued)

OTHER PUBLICATIONS

International Search Report dated Aug. 4, 2015, issued in counterpart International Application No. PCT/JP2015/002380 (2 pages).

*Primary Examiner* — Abdullah Riyami
*Assistant Examiner* — Nelson R Burgos-Guntin
(74) *Attorney, Agent, or Firm* — Westerman, Hattori, Daniels & Adrian, LLP

(57) ABSTRACT

A waterproof connection apparatus for electronic equipment includes: an approximately tubular outer case; a supporting portion accommodated in a wall form on a deep side of the outer case; a contact terminal supported by the supporting portion and introduced in the outer case; and a circumferential sealing portion provided at a position between the outer case and the supporting portion to seal a space between the outer case and the supporting portion. The sealing portion formed of an elastic material is provided so as to protrude outward from a portion of an outer circumferential surface of the supporting portion and the sealing portion is pressure-contacted to an inner surface of the outer case in a circumferential form in a state of press-fitting the protruding portion. In this way, it is possible to reliably prevent water from entering into the deep side of the outer case and to decrease the length.

22 Claims, 7 Drawing Sheets

(51) Int. Cl.
*H01R 24/66* (2011.01)
*H01R 107/00* (2006.01)

(58) Field of Classification Search
USPC .. 439/559, 660, 607.4, 607.35, 607.36, 589, 439/271
See application file for complete search history.

(56) References Cited

U.S. PATENT DOCUMENTS 6,815,610 B2 * 11/2004 Kuboshima ..... H01R 9/032 174/360
7,922,535 B1 4/2011 Jiang et al.
8,388,380 B1 * 3/2013 Van der Steen ... H01R 13/5202 439/607.36
8,696,383 B2 * 4/2014 Do ..... H01R 13/6581 439/607.35
9,711,910 B2 * 7/2017 Zhao ..... H01R 13/5202
2001/0018294 A1 * 8/2001 Kameyama ..... H01R 31/06 439/654
2002/0052140 A1 * 5/2002 Hara ..... H01R 13/521 439/587
2004/0266269 A1 * 12/2004 Miyazaki ..... H01R 4/46 439/660
2007/0155200 A1 * 7/2007 Shinohira ..... H01R 9/24 439/76.2
2007/0224881 A1 9/2007 Fujiwara et al.
2008/0299831 A1 * 12/2008 Kim ..... H01R 13/6278 439/638
2010/0009570 A1 * 1/2010 Abramov ..... H01R 13/5202 439/587
2010/0279541 A1 * 11/2010 Osaki ..... H01R 12/68 439/492
2011/0077063 A1 3/2011 Yabe et al.
2011/0294345 A1 * 12/2011 Peng ..... H01R 12/724 439/589
2012/0184152 A1 * 7/2012 Kataoka ..... H01R 13/502 439/660
2013/0307265 A1 * 11/2013 Sekino ..... F16L 19/0283 285/382.5
2013/0330951 A1 12/2013 Yudate
2014/0099811 A1 * 4/2014 Chiu ..... H01R 13/5219 439/275
2014/0302711 A1 * 10/2014 Suzuki ..... H01R 13/5202 439/556
2015/0236441 A1 * 8/2015 Kim ..... H01R 13/521 439/587
2015/0244099 A1 8/2015 Lee
2015/0244101 A1 * 8/2015 Chien ..... H01R 13/5202 439/271
2016/0172784 A1 * 6/2016 Kataoka ..... H01R 13/5219 439/271

FOREIGN PATENT DOCUMENTS

JP 5-507810 A 11/1993
JP 7-192813 A 7/1995
JP 2007-258041 A 10/2007
JP 2010-268562 A 11/2010
JP 2011-71876 A 4/2011
JP 2012-009357 A 1/2012
JP 2012-9358 A 1/2012
JP 2012-195125 A 10/2012
JP 2012-238481 A 12/2012
JP 2013-48019 A 3/2013
WO 2014/077502 A1 5/2014

* cited by examiner

WATERPROOF CONNECTION APPARATUS FOR ELECTRONIC EQUIPMENT, AND ELECTRONIC EQUIPMENT

TECHNICAL FIELD

The present invention relates to a connection apparatus used for electrical connection of various types of electronic equipment such as, for example, multifunctional mobile phones, multifunctional mobile information terminals, mobile audio players, electronic book readers, or acoustic equipment. More specifically, this invention relates to a waterproof connection apparatus for electronic equipment having a waterproof function and electronic equipment having the waterproof connection apparatus.

BACKGROUND ART

Conventionally, a waterproof connector which is accommodated in a housing of an electronic equipment and in which a supporting portion is provided in a wall form at a position close to a deep side of an approximately tubular resin case so as to block an inner side of the case, contact terminals are introduced into the case so as to pass through the supporting portion, and a filling material is filled in the space formed by the supporting portion and a circumferential wall on the back side of the case is known as a waterproof connection apparatus for electronic equipment having a waterproof function (see Patent Literature 1). This waterproof connector is configured so that water entering into the case is prevented from entering from the space between the case and the supporting portion into a circuit board provided on the deep side by the filling material on the back side of the case.

PRIOR ART LITERATURE

Patent Literature

Patent Literature 1: Japanese Patent Application Publication No. 2012-195125

SUMMARY OF INVENTION

Problem to be Solved by Invention

However, in a connection apparatus such as a connector accommodated in electronic equipment, a plug or the like inserted therein is pried out strongly and the prying force is applied several times whereby force that partially or totally inflates the case is applied intermittently. However, in a structure like the waterproof connector in which a filling material is provided in the space on the back side of a case so as to be firmly fixed to the inner surface of the case to provide a waterproof function, the filling material may peel off the inner surface of the case by the intermittently applied force and a gap may be formed between the case and the filling material. When such a gap is formed, it is difficult to prevent water from entering into the back side and waterproof performance deteriorates.

Moreover, in a structure in which a filling material is provided in the space formed by the supporting portion and the circumferential wall on the back side of the case, it is necessary to increase the length of the waterproof connector by the length of the space in order to secure the space in which the filling material is filled. This increase in the length hinders size reduction. Particularly, in small electronic equipment such as multifunctional mobile phones or multifunctional mobile information terminals, there is a strong demand to reduce the size of a connection apparatus accommodated in a connector or the like, and a connection apparatus having such a structure that enables the size thereof to be reduced is desired.

The present invention has been suggested in view of the afore-mentioned problem. An object of this invention is to provide a waterproof connection apparatus for electronic equipment capable of reliably preventing water from entering from the space between an outer case and a supporting portion accommodated therein into a deep side of the outer case with high durability and decreasing the length of the waterproof connection apparatus to realize size reduction and electronic equipment having the waterproof connection apparatus.

Means of Solving Problem

A waterproof connection apparatus for electronic equipment according to the present invention includes an approximately tubular outer case; a supporting portion accommodated in a wall form on a deep side of the outer case; a contact terminal supported by the supporting portion and introduced in the outer case; and a circumferential sealing portion provided between the outer case and the supporting portion at a position at which the outer case and the supporting portion approach each other so as to seal a space between the outer case and the supporting portion.

According to this configuration, it is possible to seal the space between the outer case and the supporting portion with the aid of the circumferential sealing portion and to secure waterproof performance between the outer case and the supporting portion. Therefore, it is not necessary to firmly fix the filling material to the inner surface of the outer case in the space on the deep side of the outer case. Moreover, it is possible to prevent the filling material from peeling off the inner surface of the outer case by the intermittently applied force to form a gap to thereby deteriorate the waterproof performance. Moreover, since the circumferential sealing portion is disposed so as to be sandwiched between the outer case and the supporting portion, it is possible to reliably prevent water from entering from the space between the outer case and the supporting portion accommodated therein into the deep side of the outer case with high durability. Furthermore, since a space for filling the filling material on the deep side of the outer case is not necessary, it is possible to decrease the length of the waterproof connection apparatus and to reduce the size thereof. Therefore, it is possible to decrease the area occupied by the waterproof connection apparatus to increase an available area inside the electronic equipment to thereby provide more freedom in the internal layout design of the electronic equipment and to achieve a reduction in the size of the electronic equipment.

In the waterproof connection apparatus for electronic equipment of the present invention, the sealing portion is formed of an elastic material and is provided in the supporting portion, and the sealing portion is pressure-contacted to an inner surface of the outer case in a circumferential form so that the supporting portion is press-fitted to the outer case.

According to this configuration, even when force that partially or totally inflates the outer case is applied to the outer case and temporary or permanent deformation occurs in the outer case, the elastic sealing portion pressure-contacted to the inner surface of the outer case can follow the inner surface of the outer case to maintain the waterproof performance. Moreover, since the supporting portion that makes pressure-contact with the sealing portion is press-fitted to the outer case, it is possible to provide the supporting portion at a predetermined position in the outer case with high stability.

In the waterproof connection apparatus for electronic equipment of the present invention, the sealing portion is provided in a state of press-fitting a protruding portion that protrudes outward from a portion of an outer circumferential surface of the supporting portion.

According to this configuration, the supporting portion and the sealing portion can be provided in the outer case by press-fitting the sealing portion protruding toward the outer circumference to the outer case. In such a structure, even when an error occurs in the positions of the sealing portion and the supporting portion in the outer case, it is possible to seal the space between the outer case and the supporting portion to secure the waterproof performance and to provide a margin in the positional accuracy of the sealing portion and the supporting portion. Therefore, it is possible to alleviate assembling accuracy to reduce a manufacturing cost and to decrease the number of defective products to improve yield. Moreover, when the sealing portion is provided on the entire outer circumferential surface of the supporting portion, frictional resistance when the supporting portion is press-fitted to the outer case increases too much. In contrast, since the sealing portion is provided in a portion of the outer circumferential surface of the supporting portion, it is possible to decrease the frictional resistance when the sealing portion is press-fitted to the outer case and to easily perform an assembling operation.

In the waterproof connection apparatus for electronic equipment of the present invention, the sealing portion is an O-ring and the O-ring is fitted to a stepped portion of the supporting portion at which the O-ring can be fixed stationary.

According to this configuration, it is possible to provide the supporting portion and the outer case of various shapes and sizes with the ability to secure waterproof and sealing properties between the space between the outer case and the supporting portion at a low cost and to enhance versatility.

In the waterproof connection apparatus for electronic equipment of the present invention, the sealing portion is formed of an elastic resin that is integrated with the supporting portion.

According to this configuration, it is possible to completely prevent water from entering from the space between the sealing portion and the supporting portion and to further enhance the sealing-based waterproof performance between the outer case and the supporting portion.

In the waterproof connection apparatus for electronic equipment of the present invention, the outer case is formed of metal.

According to this configuration, when the outer case is formed of metal, in a structure in which a resin filling material is provided in the space formed by the supporting portion and the circumferential wall on the deep side of the outer case, the resin filling material and the outer case easily peels off and the waterproof performance is more likely to deteriorate as compared to when the outer case is a resin case. In contrast, since the sealing portion is pressure-contacted to the inner surface of the metallic outer case in a circumferential form, it is possible to enhance waterproof stability and durability.

In the waterproof connection apparatus for electronic equipment of the present invention, the sealing portion is provided on a front surface side of the supporting portion and is bonded to a stepped portion of the outer case in a circumferential form. An appropriate surface positioned to face the front side (for example, an inclined surface formed in a corner portion of the supporting portion and disposed on the front surface of the supporting portion or near the front surface side) is included in the front surface side of the supporting portion.

According to this configuration, since the sealing portion on the front surface side of the supporting portion is inserted until the sealing portion abuts on the stepped portion of the outer case and is bonded to the stepped portion, it is possible to arrange the supporting portion and the sealing portion at an accurate position in the outer case to realize waterproof and sealing properties. Therefore, it is possible to enhance the uniformity of products.

In the waterproof connection apparatus for electronic equipment of the present invention, the sealing portion is a waterproof double-sided tape having one surface bonded to the front surface side of the supporting portion and the other surface bonded to the stepped portion of the outer case.

According to this configuration, it is possible to provide the supporting portion and the outer case of various shapes and sizes with the ability to secure waterproof and sealing properties between the space between the outer case and the supporting portion at a low cost and to enhance versatility.

Electronic equipment according to the present invention includes the waterproof connection apparatus for electronic equipment of the present invention accommodated in a housing.

According to this configuration, it is possible to obtain electronic equipment having the same advantages as those of the waterproof connection apparatus for electronic equipment of the present invention.

Advantageous Effects of Invention

According to the present invention, it is possible to reliably prevent water from entering from the space between an outer case and a supporting portion accommodated therein into a deep side of the outer case with high durability by sealing the circumferential sealing portion. Moreover, since the space on the deep side of the outer case is not necessary, it is possible to decrease the length of the waterproof connection apparatus and to reduce the size of the waterproof connection apparatus.

EMBODIMENTS FOR CARRYING OUT INVENTION

Figure 1:
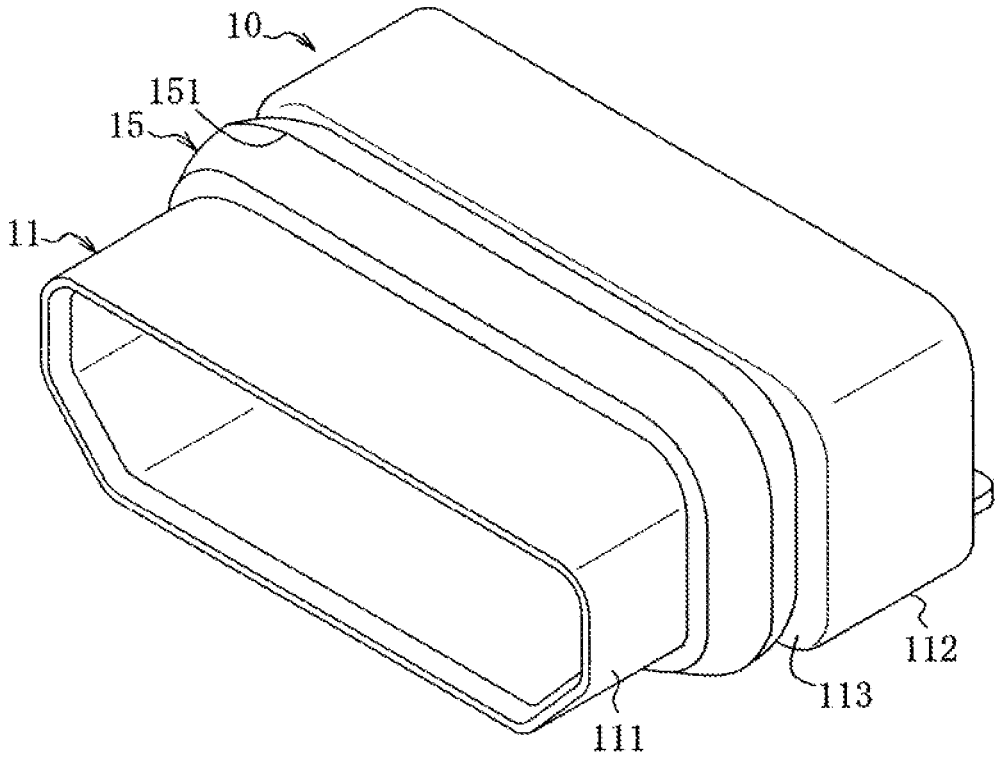
FIG. 1 is a perspective view illustrating a waterproof connection apparatus according to a first embodiment of this invention.
Figure 2:
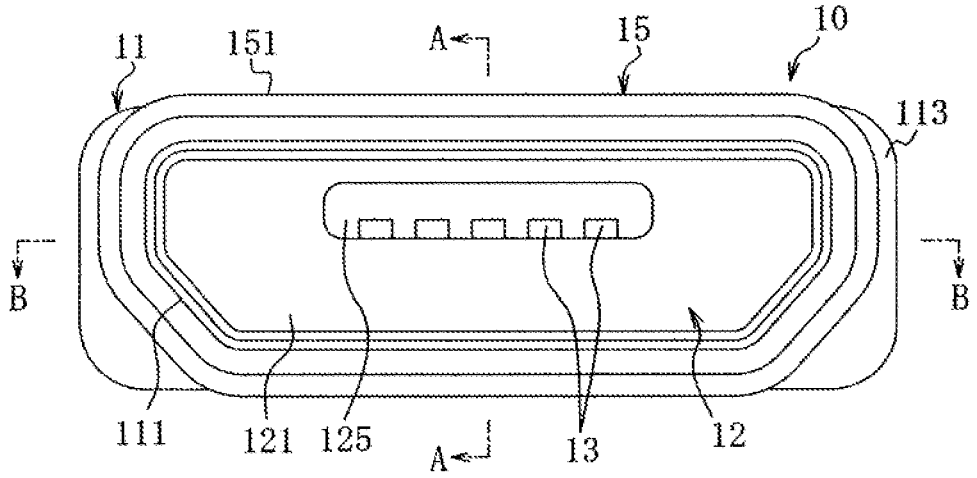
FIG. 2 is a front view illustrating the waterproof connection apparatus according to the first embodiment.

[Waterproof Connection Apparatus for Electronic Equipment According to First Embodiment]

A waterproof connection apparatus 10 for electronic equipment according to a first embodiment of the present invention is a waterproof connector which conforms to a standard such as the micro-USB standard and which is accommodated in electronic equipment such as mobile small-size electronic equipment such as, for example, multifunctional mobile phones, multifunctional mobile information terminals, mobile audio players, or electronic book readers.

As illustrated in FIGS. 1 to 4, the waterproof connection apparatus 10 according to the first embodiment includes an approximately seamless tubular shell 11, and the shell 11 corresponds to an approximately tubular outer case. A supporting portion 12 is accommodated in a wall form on the deep side of the shell 11, the supporting portion 12 supports contact terminals 13 provided so as to pass through the supporting portion 12, and the front portions of the contact terminals 13 are introduced into the shell 11.

The shell 11 is seamless and the shell 11 is formed in an approximately square tubular form. A stepped portion 113 extending from a front portion 111 located close to an insertion side of a male-side connecting tool or a plug to a rear portion 112 having a height and a width larger than those of the front portion 111 is formed in a circumferential form on a circumferential surface so as to bulge outward. The shell 11 is formed so that at least a region located closer to a front side than a front surface of the supporting portion 12 is formed as a non-perforated surface, and in this example, an entire region extending across the front portion 111, the stepped portion 113, and the rear portion 112 is formed as a non-perforated surface.

The supporting portion 12 is formed of an insulating hard resin and is provided in a wall form so as to block the back side of the shell 11. The supporting portion 12 has an approximately rectangular parallelepiped body 121 having a recess at the center and is accommodated in and fitted to the rear portion 112 of the shell 11 so that a partial front surface 122 of the body 121 abuts on the inner surface of the stepped portion 113. Moreover, a circumferential recess 124 made up of a groove and a notch is formed in a portion of an outer circumferential surface 123 of the supporting portion 12, and an O-ring 14 is fitted to the recess 124 so that the O-ring 14 is provided in the supporting portion 12. The O-ring 14 corresponds to a circumferential sealing portion and the recess 124 corresponds to a stepped portion at which the O-ring 14 can be fixed stationary.

The O-ring 14 is formed of an elastic material such as rubber or a soft resin. The O-ring 14 is formed in a circumferential form and has an approximately circular cross-section. The O-ring 14 is provided so that a portion of the O-ring 14 protrudes outward from a portion of the outer circumferential surface 123 of the supporting portion 12 in a state before the supporting portion 12 is accommodated in the shell 11. Moreover, the supporting portion 12 is press-fitted to the shell 11 so as to crush the protruding portion of the O-ring 14. In the present embodiment, the O-ring 14 is pressure-contacted to the inner surface of the shell 11 in a circumferential form in a state in which the supporting portion 12 is press-fitted at a position at which the front surface 122 abuts on the inner surface of the stepped portion 113. That is, the O-ring 14 corresponding to a circumferential sealing portion that seals the space between the supporting portion 12 and the shell 11 corresponding to the outer case is provided between the shell 11 and the supporting portion 12 at a position at which the shell 11 and the supporting portion 12 approach each other.

Furthermore, a plurality of contact terminals 13 are partially buried in the supporting portion 12 by insert molding so as to pass through the body 121. The contact terminals 13 are attached to the supporting portion 12 by insert molding so as to form a watertight structure. In the illustrated example, the contact terminals 13 are arranged along one side of the protruding portion 125 that protrudes from the front side of the supporting portion 12 and are introduced into the shell 11. The contact terminals 13 are exposed in the shell 11 so that the contact terminals 13 can make conductive contact with plug-side terminals, and the contact terminals 13 are pulled from the rear side of the body 121 and are connected to a circuit board of the electronic equipment (not illustrated). An appropriate terminal of the plurality of contact terminals 13 can be configured as a power supply terminal and a ground terminal which is electrically connected to the shell 11.

Figure 3:
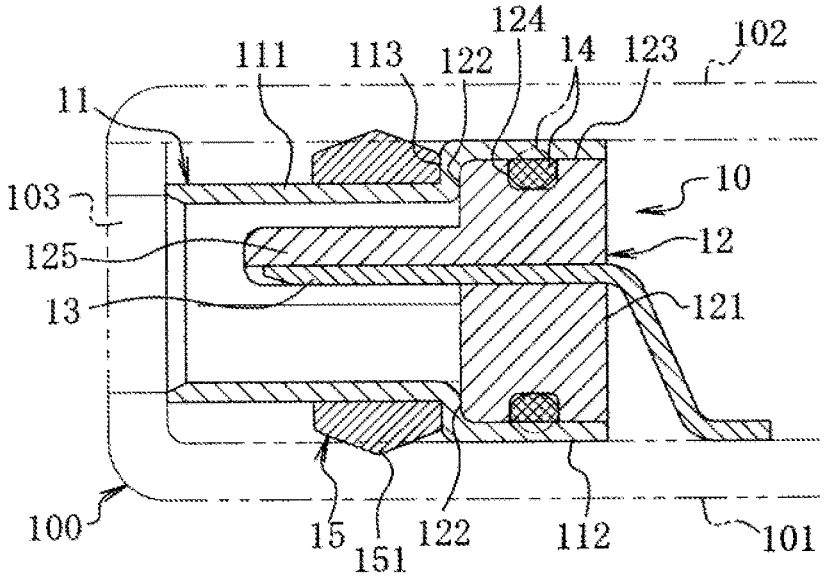
FIG. 3 is a sectional view taken along line A-A in FIG. 2.
Figure 4:
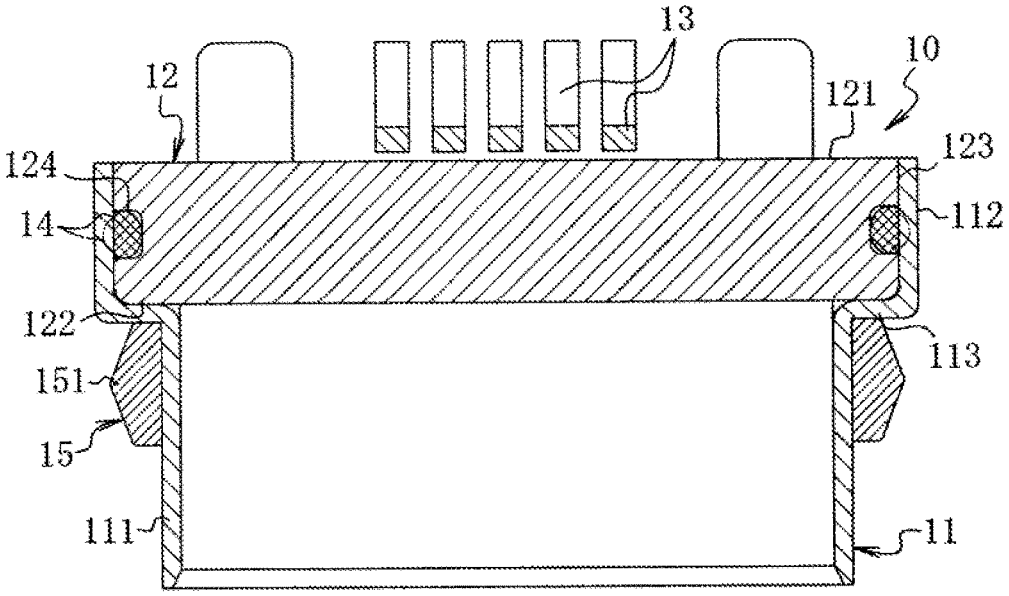
FIG. 4 is a sectional view taken along line B-B in FIG. 2.
Figure 5:
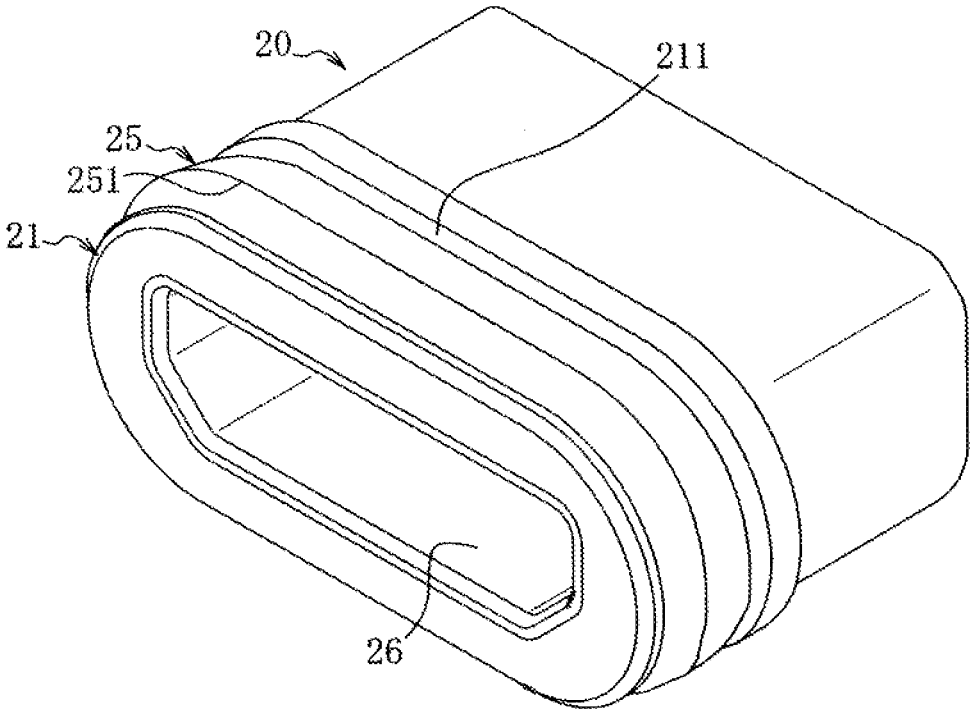
FIG. 5 is a perspective view illustrating a waterproof connection apparatus according to a second embodiment of this invention.
Figure 6:
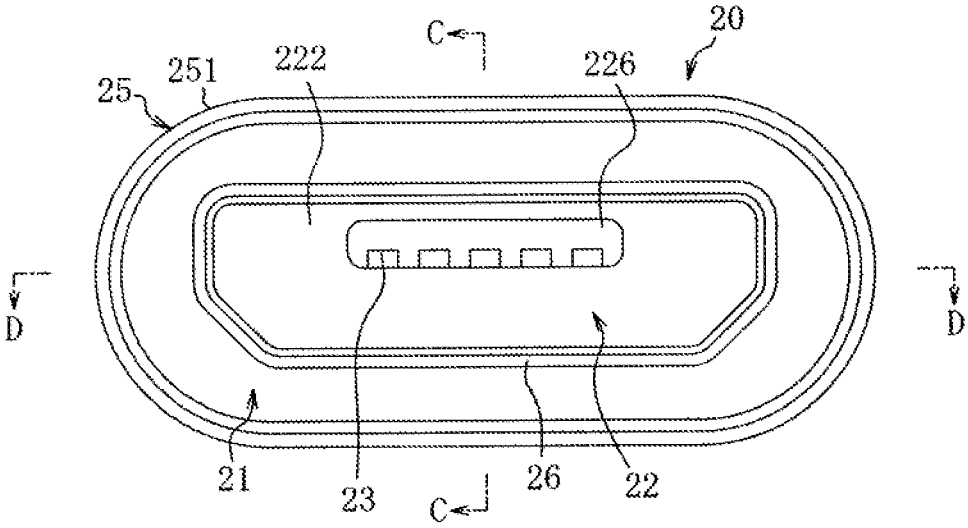
FIG. 6 is a front view illustrating a waterproof connection apparatus according to the second embodiment.
Figure 7:
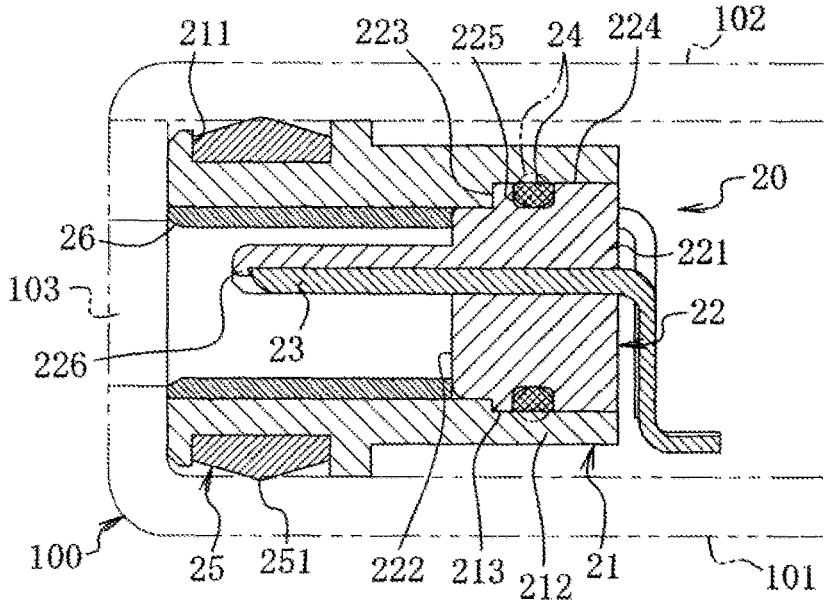
FIG. 7 is a sectional view taken along line C-C in FIG. 6.
Figure 8:
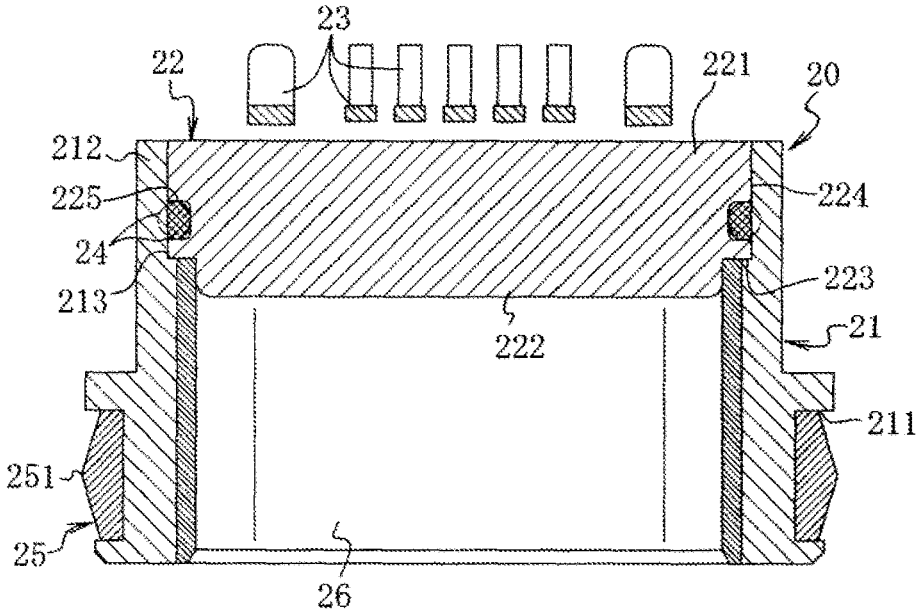
FIG. 8 is a sectional view taken along line D-D in FIG. 6.
Figure 9:
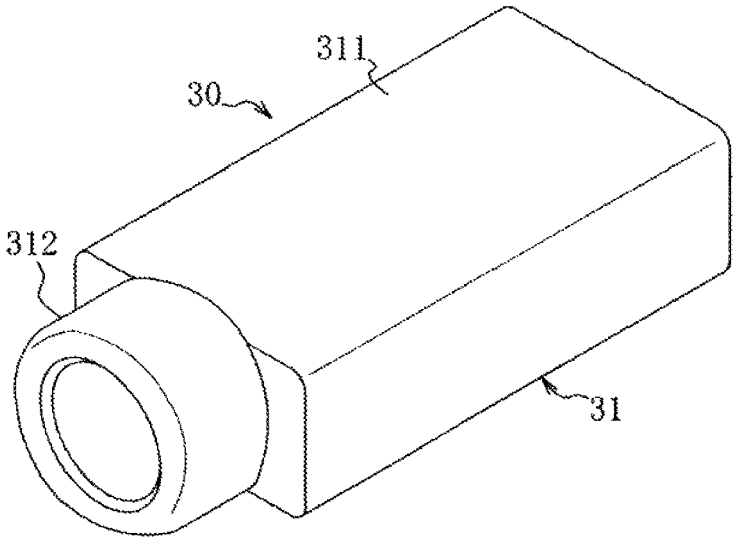
FIG. 9 is a perspective view illustrating a waterproof connection apparatus according to a third embodiment of this invention.
Figure 10:
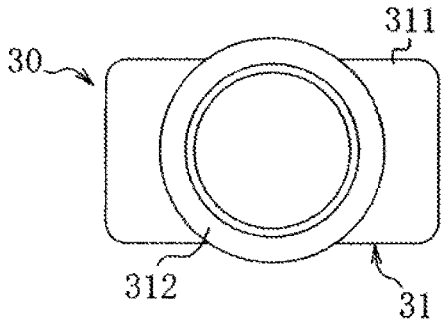
FIG. 10 is a front view illustrating a waterproof connection apparatus according to the third embodiment.
Figure 11:
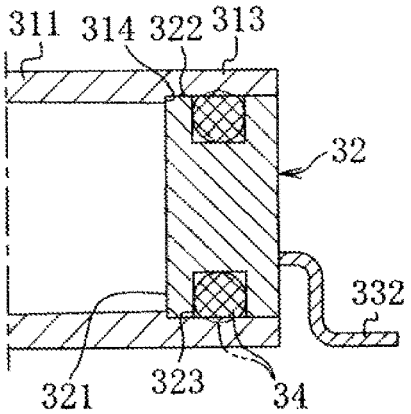
FIG. 11 is a longitudinal sectional view of a main part of the waterproof connection apparatus according to the third embodiment.
Figure 12:
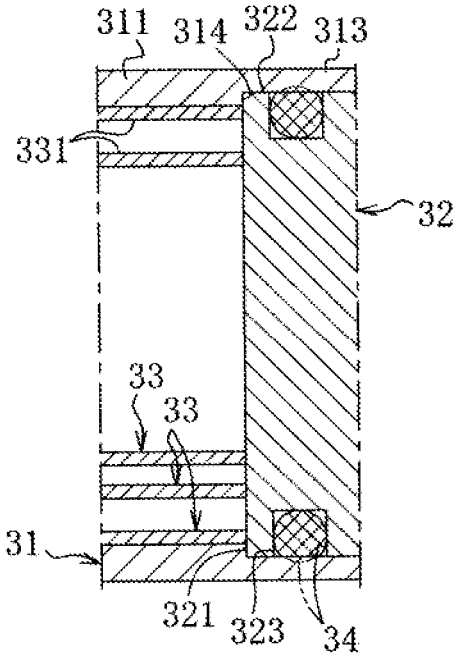
FIG. 12 is a cross-sectional view of a main part of the waterproof connection apparatus according to the third embodiment.

Moreover, the sealing member 15 is fitted to an outer circumference of the shell 11 at a position close to the rear side of the front portion 111 so that one side surface thereof abuts on the stepped portion 113 in a circumferential form. The sealing member 15 is formed of a soft resin such as elastomer in an approximately rectangular frame-shaped ring form and has a protruding strip 151 which has an approximately ridge-shaped cross-section and protrudes outward from a body having an approximately rectangular cross-section. The protruding strip 151 is pressure-contacted to the housing 100 in a circumferential form by being pressed against a housing body 101 and a lid 102 that form the housing 100 of the electronic equipment, for example, when the waterproof connection apparatus 10 is accommodated in and attached to the housing 100 of the electronic equipment whereby a watertight structure is formed (see FIG. 3). In FIG. 3, a connecting tool insertion opening 103 for a plug or the like is formed in a side wall of the housing body 101.

The waterproof connection apparatus 10 according to the first embodiment can be manufactured by an appropriate applicable method. According to a preferred manufacturing method, for example, a metal flat plate is subjected to drawing press processing to form the metallic shell 11 having a predetermined shape, the contact terminals 13 are subjected to insert molding to form the supporting portion 12 having a predetermined shape by injection molding, and the O-ring 14 is fitted to the recess 124 of the supporting portion 12.

The supporting portion 12 in which the O-ring 14 corresponding to the circumferential sealing portion is provided is inserted into the shell 11 corresponding to the outer case from the rear portion 112 side. In this instance, the O-ring 14 protruding toward the outer circumference from a portion of the outer circumferential surface 123 of the supporting portion 12 is press-fitted to the shell 11 by sliding on the inner surface of the shell 11 so as to be crushed by the inner surface of the shell 11.

The supporting portion 12 is inserted up to a position at which the front surface 122 of the supporting portion 12 abuts on the inner surface of the stepped portion 113, the inserted O-ring 14 is pressure-contacted to the inner surface of the shell 11 in a circumferential form, and the O-ring 14 provided at a predetermined position between the shell 11 and the supporting portion 12 seals the space between the shell 11 and the supporting portion 12. After that, the sealing member 15 is fitted to the outer circumference at a position close to the rear side of the front portion 111 so that the side surface thereof abuts on the stepped portion 113 whereby the waterproof connection apparatus 10 which is a waterproof connector is obtained. Alternatively, the supporting portion 12 may be press-fitted to the shell 11 in which the sealing member 15 is fitted to the outer circumference thereof.

According to the waterproof connection apparatus 10 according to the first embodiment, it is possible to seal the space between the shell 11 and the supporting portion 12 with the aid of the circumferential O-ring 14 to secure the waterproof performance between the shell 11 and the supporting portion 12. Therefore, it is not necessary to firmly fix the filling material to the inner surface of the shell 11 in the space on the deep side of the shell 11. Moreover, it is possible to prevent the filling material from peeling off the inner surface of the shell 11 by the intermittently applied force to form a gap to thereby deteriorate the waterproof performance. Moreover, since the O-ring 14 is disposed so as to be sandwiched between the shell 11 and the supporting portion 12, it is possible to reliably prevent water from entering from the space between the shell 11 and the supporting portion 12 accommodated therein into the deep side of the shell 11 with high durability.

Moreover, since a space for filling the filling material on the deep side of the shell 11 is not necessary, it is possible to decrease the length of the waterproof connection apparatus 10 to reduce the size thereof. Therefore, it is possible to decrease the area occupied by the waterproof connection apparatus 10 to increase an available area inside the electronic equipment to thereby provide more freedom in the internal layout design of the electronic equipment and to achieve a reduction in the size of the electronic equipment.

Moreover, since the O-ring 14 formed of an elastic material is pressure-contacted to the inner surface of the shell 11 in a circumferential form, even when force that partially or totally inflates the shell 11 is applied to the shell 11 and temporary or permanent deformation occurs in the shell 11, the elastic O-ring 14 can follow the inner surface of the shell 11 to maintain the waterproof performance. Furthermore, since the supporting portion 12 is press-fitted to the shell 11, it is possible to provide the supporting portion 12 at a predetermined position in the shell 11 with high stability.

Moreover, in a structure in which the O-ring 14 protruding toward the outer circumference is press-fitted to the shell 11 and the supporting portion 12 and the O-ring 14 are provided in the shell 11, even when an error occurs in the positions of the O-ring 14 and the supporting portion 12 in the shell 11, it is possible to seal the space between the shell 11 and the supporting portion 12 to secure the waterproof performance and to provide a margin in the positional accuracy of the O-ring 14 and the supporting portion 12. Therefore, it is possible to alleviate assembling accuracy to reduce a manufacturing cost and to decrease the number of defective products to improve yield.

Moreover, when the sealing portion is provided on the entire outer circumferential surface 123 of the supporting portion 12, frictional resistance when the supporting portion 12 is press-fitted to the shell 11 increases too much. In contrast, since the O-ring 14 is provided in a portion of the outer circumferential surface 123 of the supporting portion 12, it is possible to decrease the frictional resistance when the O-ring 14 is press-fitted to the shell 11 and to easily perform an assembling operation.

Moreover, due to the structure in which the O-ring 14 as the sealing portion is fitted to the supporting portion 12, it is possible to provide waterproof and sealing properties to the shell 11 and the supporting portion 12 of various shapes and sizes at a low cost and to enhance versatility. Furthermore, when the outer case is the metallic shell 11, in a structure in which a resin filling material is provided in the space formed by the supporting portion 12 and the circumferential wall on the deep side of the shell 11, the resin filling material and the outer case easily peels off and the waterproof performance is more likely to deteriorate as compared to when the outer case is a resin case. In contrast, since the O-ring 14 is pressure-contacted to the inner surface of the metallic shell 11 in a circumferential form, it is possible to enhance waterproof stability and durability.

[Waterproof Connection Apparatus for Electronic Equipment According to Second Embodiment]

Similarly to the first embodiment, a waterproof connection apparatus 20 for electronic equipment according to a second embodiment of the present invention is a waterproof connector which conforms to a standard such as the micro-USB standard and which is accommodated in electronic equipment such as mobile small-size electronic equipment such as, for example, multifunctional mobile phones, multifunctional mobile information terminals, mobile audio players, or electronic book readers.

As illustrated in FIGS. 5 to 8, the waterproof connection apparatus 20 according to the second embodiment includes an approximately tubular resin case 21, and the case 21 corresponds to an approximately tubular outer case. A supporting portion 22 is accommodated in a wall form on the deep side of the case 21, the supporting portion 22 supports contact terminals 23 provided so as to pass through the supporting portion 22, and the front portions of the contact terminals 23 are introduced into the case 21. Moreover, a metallic shell 26 is attached on the inner side of the case 21, located closer to a front side than a portion which is blocked by the supporting portion 22, and the front portions of the contact terminals 23 are arranged on the inner side of the shell 26.

The case 21 has an approximately rectangular tubular form and is formed of a hard resin such as a polycarbonate resin or an ABS resin. A recessed groove 211 is formed along an outer circumferential surface located close to the front side of the case 21, and a sealing member 25 to be described later is provided in a state of being fitted to the recessed groove 211. A stepped portion 213 is formed on the inner side close to the rear portion 212 of the case 21, and the space on the inner side of the rear portion 212 of the case 21 has a height and a width larger than that of the space on the inner side of a portion located closer to the front side.

The supporting portion 22 is formed of an insulating hard resin and is provided in a wall form so as to block the deep side of the case 21. The supporting portion 22 has an approximately rectangular parallelepiped body 221, an approximately rectangular columnar stepped portion 222 is formed near the front end of the body 221 so that a central region thereof protrudes forward, and the stepped portion 222 is fitted to the front portion of the case 21.

The supporting portion 22 is accommodated in and fitted to the rear portion 212 of the case 21 so that a front surface 223 located closer to the outer circumference than the stepped portion 222 abuts on the inner surface of the stepped portion 213 of the case 21. Moreover, a circumferential recess 225 configured as a groove is formed in a portion of an outer circumferential surface 224 of the supporting portion 22, and the O-ring 24 is fitted to the recess 225 so that the O-ring 24 is provided in the supporting portion 22. The O-ring 24 corresponds to a circumferential sealing portion, and the recess 225 corresponds to a stepped portion at which the O-ring 24 can be fixed stationary.

The O-ring 24 is formed of an elastic material such as rubber or a soft resin. The O-ring 24 is formed in a circumferential form and has an approximately circular cross-section. The O-ring 24 is provided so that a portion of the O-ring 24 protrudes outward from a portion of the outer circumferential surface 224 of the supporting portion 22 in a state before the supporting portion 22 is accommodated in the case 21. Moreover, the supporting portion 22 is press-fitted to the case 21 so as to crush the protruding portion of the O-ring 24. In the present embodiment, the O-ring 24 is pressure-contacted to the inner surface of the case 21 in a circumferential form in a state in which the supporting portion 22 is press-fitted at a position at which the front surface 223 abuts on the inner surface of the stepped portion 213. That is, the O-ring 24 corresponding to a circumferential sealing portion that seals the space between the supporting portion 22 and the case 21 corresponding to the outer case is provided between the case 21 and the supporting portion 22 at a position at which the case 21 and the supporting portion 22 approach each other.

Furthermore, similarly to the first embodiment, a plurality of contact terminals 23 is partially buried in the supporting portion 22 by insert molding so as to pass through the body 221. The contact terminals 23 are attached to the supporting portion 22 so as to form a watertight structure by insert molding. In the illustrated example, the contact terminals 23 are arranged along one side of the protruding portion 226 that protrudes from the front side of the supporting portion 22 and are introduced into the case 21 and the shell 26. The contact terminals 23 are exposed in the case 21 and the shell 26 so that the contact terminals 23 can make conductive contact with terminals close to a plug or the like, and the contact terminals 23 are pulled from the rear side of the body 221 and are connected to a circuit board of the electronic equipment (not illustrated). An appropriate terminal of the plurality of contact terminals 23 can be configured as a power supply terminal and a ground terminal which is electrically connected to the shell 26.

Moreover, the sealing member 25 fitted to an outer circumference of the case 21 is formed of a soft resin such as elastomer in an approximately rectangular frame-shaped ring form and has a protruding strip 251 which has an approximately ridge-shaped cross-section and protrudes outward from a body having an approximately rectangular cross-section. The protruding strip 251 is pressure-contacted to the housing 100 in a circumferential form by being pressed against a housing body 101 having a connecting tool insertion opening 103 for a plug or the like and a lid 102 that form the housing 100 of the electronic equipment, for example, when the waterproof connection apparatus 20 is accommodated in and attached to the housing 100 of the electronic equipment whereby a watertight structure is formed (see FIG. 7).

The waterproof connection apparatus 20 according to the second embodiment can be manufactured by an appropriate applicable method. According to a preferred manufacturing method, for example, the case 21 having a predetermined shape is formed by injection molding, the contact terminals 23 are subjected to insert molding to form the supporting portion 22 having a predetermined shape by injection molding, and the O-ring 24 is fitted to the recess 225 of the supporting portion 22.

The supporting portion 22 in which the O-ring 24 corresponding to the circumferential sealing portion is provided is inserted into the case 21 corresponding to the outer case from the rear portion 212 side. In this instance, the O-ring 24 protruding toward the outer circumference from a portion of the outer circumferential surface 224 of the supporting portion 22 is press-fitted to the case 21 by sliding on the inner surface of the case 21 so as to be crushed by the inner surface of the case 21. In this example, a portion of the case 21 close to the rear end of the rear portion 212 is preferably formed in such a tapered form as to spread toward the rear end so that the supporting portion 22 is inserted easily.

The supporting portion 22 is inserted up to a position at which the front surface 223 of the supporting portion 22 abuts on the inner surface of the stepped portion 213 of the case 21, the inserted O-ring 24 is pressure-contacted to the inner surface of the case 21 in a circumferential form, and the O-ring 24 provided at a predetermined position between the case 21 and the supporting portion 22 seals the space between the case 21 and the supporting portion 22.

After that, the shell 26 is inserted from the front side so as to be accommodated in the case 21 so that a portion of the shell 26 near the rear end is fitted between the inner surface of the case 21 and the side surface of the stepped portion 222 of the supporting portion 22, and the sealing member 25 is fitted to the recessed groove 211 of the case 21 whereby the waterproof connection apparatus 20 which is the waterproof connector is obtained. Alternatively, the supporting portion 22 may be press-fitted from the rear portion 212 side in a state in which the shell 26 is accommodated in the case 21 to create a state in which a portion of the shell 26 close to the rear end is fitted between the inner surface of the case 21 and the side surface of the stepped portion 222 of the supporting portion 22. Still alternatively, press-fitting of the supporting portion 22, insertion of the shell 26, or both may be performed in a state in which the sealing member 25 is attached to the case 21.

According to the waterproof connection apparatus 20 according to the second embodiment, it is possible to seal the space between the case 21 and the supporting portion 22 with the aid of the circumferential O-ring 24 to secure the waterproof performance between the case 21 and the supporting portion 22. Therefore, it is not necessary to firmly fix the filling material to the inner surface of the case 21 in the space on the deep side of the case 21. Moreover, it is possible to prevent the filling material from peeling off the inner surface of the case 21 by the intermittently applied force to form a gap to thereby deteriorate the waterproof performance. Furthermore, since the O-ring 24 is disposed so as to be sandwiched between the case 21 and the supporting portion 22, it is possible to reliably prevent water from entering from the space between the case 21 and the supporting portion 22 accommodated therein into the deep side of the case 21 with high durability.

Moreover, since a space for filling the filling material on the deep side of the case 21 is not necessary, it is possible to decrease the length of the waterproof connection apparatus 20 to reduce the size thereof. Therefore, it is possible to decrease the area occupied by the waterproof connection apparatus 20 to increase an available area inside the electronic equipment to thereby provide more freedom in the internal layout design of the electronic equipment and to achieve a reduction in the size of the electronic equipment.

Moreover, since the O-ring 24 formed of an elastic material is pressure-contacted to the inner surface of the case 21 in a circumferential form, even when force that partially or totally inflates the case 21 is applied to the case 21 and temporary or permanent deformation occurs in the case 21, the elastic O-ring 24 can follow the inner surface of the case 21 to maintain the waterproof performance. Furthermore, since the supporting portion 22 is press-fitted to the case 21, it is possible to provide the supporting portion 22 at a predetermined position in the case 21 with high stability.

Moreover, similarly to the first embodiment, even when an error occurs in the positions of the O-ring 24 and the supporting portion 22 in the case 21, since it is possible to secure the waterproof performance and to provide a margin in the positional accuracy of the O-ring 24 and the supporting portion 22, it is possible to alleviate assembling accuracy to reduce a manufacturing cost and to decrease the number of defective products to improve yield. Furthermore, since the O-ring 24 is provided in a portion of the outer circumferential surface 224 of the supporting portion 22, it is possible to decrease the frictional resistance when the O-ring 24 is press-fitted to the case 21 and to easily perform an assembling operation.

[Waterproof Connection Apparatus for Electronic Equipment According to Third Embodiment]

A waterproof connection apparatus 30 for electronic equipment according to a third embodiment of the present invention is a multipolar waterproof jack such as an earphone jack, which is accommodated in electronic equipment such as mobile small-size electronic equipment such as, for example, multifunctional mobile phones, multifunctional mobile information terminals, or mobile audio players.

As illustrated in FIGS. 9 to 12, the waterproof connection apparatus 30 according to the third embodiment includes an approximately tubular resin housing 31, and the housing 31 corresponds to an approximately tubular outer case. A supporting portion 32 is accommodated in a wall form on the deep side of the housing 31, the supporting portion 32 supports contact terminals 33 provided so as to pass through the supporting portion 32, and the front portions of the contact terminals 33 are introduced into the housing 31.

The housing 31 is formed of a hard resin such as a polycarbonate resin or an ABS resin. A body 311 of the housing 31 has an approximately rectangular tubular form, and a front portion 312 on a plug insertion side has an approximately cylindrical form. A stepped surface 314 on which the supporting portion 32 abuts is formed on an inner surface of the rear portion 313 of the body 311.

The supporting portion 32 is formed of an insulating hard resin in an approximately rectangular parallelepiped form and is provided in a wall form so as to block the deep side of the housing 31. The supporting portion 32 is accommodated in and fitted to a rear portion 313 of the housing 31 so that a portion of the supporting portion 32 close to a peripheral edge of a front surface 321 abuts on the stepped surface 314 of the housing 31.

A circumferential recess 323 configured as a groove is formed in a portion of an outer circumferential surface 322 of the supporting portion 32, and an O-ring 34 is fitted to the recess 323 so that the O-ring 34 is provided in the supporting portion 32. The O-ring 34 corresponds to a circumferential sealing portion, and the recess 323 corresponds to a stepped portion at which the O-ring 34 can be fixed stationary.

The O-ring 34 is formed of an elastic material such as rubber or a soft resin. The O-ring 34 is formed in a circumferential form and has an approximately circular cross-section. The O-ring 34 is provided so that a portion of the O-ring 34 protrudes from a portion of the outer circumferential surface 322 of the supporting portion 32 toward the outer circumference in a state before the supporting portion 32 is accommodated in the housing 31. Moreover, the supporting portion 32 is press-fitted to the housing 31 so as to crush the protruding portion of the O-ring 34. In the present embodiment, the O-ring 34 is pressure-contacted to the inner surface of the housing 31 in a circumferential form in a state in which the supporting portion 32 is press-fitted at a position at which the front surface 321 abuts on the stepped portion 314. That is, the O-ring 34 corresponding to a circumferential sealing portion that seals the space between the supporting portion 32 and the housing 31 corresponding to the outer case is provided between the housing 31 and the supporting portion 32 at a position at which the housing 31 and the supporting portion 32 approach each other.

Moreover, in the present embodiment, the contact terminal 33 supported by the supporting portion 32 includes a contacting terminal portion 331 having a plate spring form, which makes contact with a plug-side terminal at a contact point at the distal end thereof and an extension terminal portion 332 provided so as to pass through the supporting portion 32 and supported by the supporting portion 32. The respective contacting terminal portions 331 are accommodated in the housing 31 so that a portion thereof is fitted to an attachment groove (not illustrated) formed in the housing 31. The respective extension terminal portions 332 are partially buried in the supporting portion 32 by insert molding and are attached to the supporting portion 32 by insert molding so as to form a watertight structure.

In a state in which the supporting portion 32 is press-fitted at a predetermined position in the housing 31, the respective extension terminal portions 332 partially exposed on the front side of the supporting portion 32 and the corresponding contacting terminal portions 331 accommodated in the housing 31 are electrically connected to form the respective contact terminals 33. A structure that electrically connects the extension terminal portion 332 and the contacting terminal portion 331 can be realized by, for example, a configuration in which an insertion hole to which the distal end of the extension terminal portion 332 is exposed is formed on the inner side of the front surface of the supporting portion 32, the supporting portion 32 is press-fitted so that the rear end of the contacting terminal portion 331 is inserted into the insertion hole, and the extension terminal portion 332 and the contacting terminal portion 331 are pressure-contacted and connected so that the distal end of the extension terminal portion 332 and the rear end of the contacting terminal portion 331 are sandwiched at the insertion hole. Alternatively, the structure can be realized by a configuration in which any one of the distal end of the extension terminal portion 332 and the rear end of the contacting terminal portion 331 is configured as a plate spring so as to be connected to the other end in an elastically contacting manner.

The respective contact terminals 33 can be formed integrally by insert-molding the rear portions thereof to the supporting portion 32 so as to pass through the supporting portion 32. In this instance, the contact terminals 33 are accommodated in the housing 31 so that the contact terminals 33 are inserted in the attachment groove of the housing 31 when the supporting portion 32 is press-fitted.

Moreover, the contact terminals 33 are provided to be exposed in the housing 31 so that the contact terminals 33 can make contact with the plug-side terminals at the contact points at the distal end. The contact terminals 33 are pulled from the rear side of the supporting portion 32 and are connected to a circuit board of the electronic equipment (not illustrated). The waterproof connection apparatus 30 which is a waterproof jack configured in this manner is accommodated in and attached to the housing 100 of the electronic equipment similarly to the first and second embodiments.

The waterproof connection apparatus 30 according to the third embodiment can be manufactured by an appropriate applicable method. According to a preferred manufacturing method, for example, the housing 31 having a predetermined shape is formed by injection molding, the contact terminals 33 or the extension terminal portions 332 of the contact terminals 33 are subjected to insert molding to form the supporting portion 32 having a predetermined shape by injection molding, and the O-ring 34 is fitted to the recess 323 of the supporting portion 32.

The supporting portion 32 in which the O-ring 34 corresponding to the circumferential sealing portion is provided is inserted into the housing 31 corresponding to the outer case from the rear portion 313 side. In this instance, the O-ring 34 protruding toward the outer circumference from a portion of the outer circumferential surface 322 of the supporting portion 32 is press-fitted to the housing 31 by sliding on the inner surface of the housing 31 so as to be crushed by the inner surface of the housing 31.

The supporting portion 32 is inserted up to a position at which the front surface 321 of the supporting portion 32 abuts on the stepped surface 314 of the housing 31, the inserted O-ring 34 is pressure-contacted to the inner surface of the housing 31 in a circumferential form, and the O-ring 34 provided at a predetermined position between the housing 31 and the supporting portion 32 seals the space between the housing 31 and the supporting portion 32. In this way, the waterproof connection apparatus 30 which is a multipolar waterproof jack is obtained.

When the extension terminal portions 332 of the contact terminals 33 are insert-molded to the supporting portion 32, before the supporting portion 32 is inserted, the contacting terminal portions 331 are accommodated in the housing 31, and then, the supporting portion 32 is inserted. In a stage where the supporting portion 32 is inserted up to a predetermined position, the contacting terminal portions 331 and the extension terminal portions 332 insert-molded to the supporting portion 32 are pressure-contacted and electrically connected. Moreover, similarly to the first and second embodiments, a portion of the housing 31 close to the rear end may be formed in such a tapered form as to spread toward the rear end so that the supporting portion 32 is inserted easily.

According to the waterproof connection apparatus 30 according to the third embodiment, it is possible to seal the space between the housing 31 and the supporting portion 32 with the aid of the circumferential O-ring 34 to secure the waterproof performance between the housing 31 and the supporting portion 32. Therefore, it is not necessary to firmly fix the filling material to the inner surface of the housing 31 in the space on the deep side of the housing 31. Moreover, it is possible to prevent the filling material from peeling off the inner surface of the housing 31 by the intermittently applied force to form a gap to thereby deteriorate the waterproof performance. Furthermore, since the O-ring 34 is disposed so as to be sandwiched between the housing 31 and the supporting portion 32, it is possible to reliably prevent water from entering from the space between the housing 31 and the supporting portion 32 accommodated therein into the deep side of the housing 31 with high durability.

Moreover, since a space for filling the filling material on the deep side of the housing 31 is not necessary, it is possible to decrease the length of the waterproof connection apparatus 30 to reduce the size thereof. Therefore, it is possible to decrease the area occupied by the waterproof connection apparatus 30 to increase an available area inside the electronic equipment to thereby provide more freedom in the internal layout design of the electronic equipment and to achieve a reduction in the size of the electronic equipment.

Moreover, since the O-ring 34 formed of an elastic material is pressure-contacted to the inner surface of the housing 31 in a circumferential form, even when force that partially or totally inflates the housing 31 is applied to the housing 31 and temporary or permanent deformation occurs in the housing 31, the elastic O-ring 34 can follow the inner surface of the housing 31 to maintain the waterproof performance. Furthermore, since the supporting portion 32 is press-fitted to the housing 31, it is possible to provide the supporting portion 32 at a predetermined position in the housing 31 with high stability.

Moreover, similarly to the first and second embodiments, even when an error occurs in the positions of the O-ring 34 and the supporting portion 32 in the housing 31, since it is possible to secure the waterproof performance and to provide a margin in the positional accuracy of the O-ring 34 and the supporting portion 32, it is possible to alleviate assembling accuracy to reduce a manufacturing cost and to decrease the number of defective products to improve yield. Furthermore, since the O-ring 34 is provided in a portion of the outer circumferential surface 322 of the supporting portion 32, it is possible to decrease the frictional resistance when the O-ring 34 is press-fitted to the housing 31 and to easily perform an assembling operation.

[Modifications of Embodiments]

The invention disclosed in this specification includes, in addition to the structures according to respective inventions or embodiments, in an applicable range, a matter defined by modifying any of these partial configurations into other configurations disclosed in this specification, a matter defined by adding any other configurations disclosed in this specification to these partial configurations, or a matter defined into a generic concept by cancelling any of these partial configurations within a limit that achieves a partial operational advantage. The invention disclosed in this specification further includes the following modifications.

For example, in the first to third embodiments, although the O-ring 14, 24, or 34 is used as the circumferential sealing portion, an appropriate member may be provided at a predetermined position between an outer case and a supporting portion so as to be able to seal the space between the outer case and the supporting portion may be used as the circumferential sealing portion of the present invention. As a preferred modification thereof, a waterproof connection apparatus 10*a* according to a modification of the first embodiment is illustrated in FIG. 13.

Figure 13:
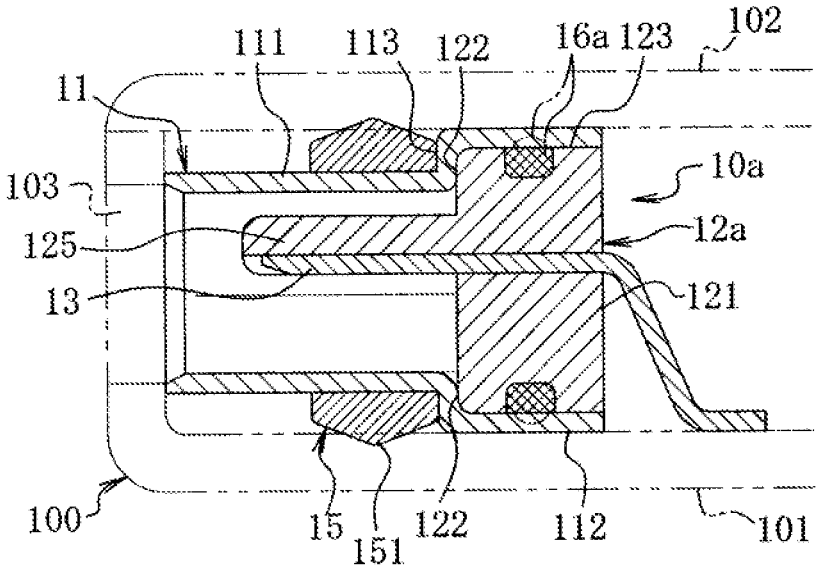
FIG. 13 is a sectional view corresponding to the view taken along line A-A, illustrating a first modification of the waterproof connection apparatus according to the first embodiment.

In the waterproof connection apparatus 10*a* illustrated in FIG. 13, an elastic resin sealing portion 16*a* formed of an elastic resin is provided in a portion corresponding to the recess 124 of a supporting portion 12*a* instead of a configuration in which the recess 124 is formed in the supporting portion 12 and the O-ring 14 is fitted to the recess 124. The elastic resin sealing portion 16*a* is integrally fixed to the supporting portion 12*a* formed of a hard resin and has a protruding portion that protrudes toward the outer circumference from the outer circumferential surface 123 of the supporting portion 12*a*. In a state in which the supporting portion 12*a* is press-fitted to the shell 11, the protruding portion of the elastic resin sealing portion 16*a* is press-fitted by the shell 11, whereby the elastic resin sealing portion 16*a* is pressure-contacted to the inner surface of the shell 11 in a circumferential form. The other configurations are the same as those of the first embodiment. In this example, it is possible to completely prevent water from entering from the space between the elastic resin sealing portion 16*a* and the supporting portion 12*a* and to further enhance the sealing-based waterproof performance. The same modification can be appropriately applied to the second and third embodiments.

Moreover, a configuration in which the circumferential sealing portion is provided is not limited to a configuration in which the sealing portion is provided so as to protrude outward from the outer circumferential surface of the supporting portion. For example, a configuration in which the sealing portion is provided so as to protrude toward the front surface of the supporting portion or a configuration in which the circumferential sealing portion is provided so as to protrude toward both the front surface of the supporting portion and the outer circumference may be used. As a preferred modification, a waterproof connection apparatus 10*b* according to a modification of the first embodiment is illustrated in FIG. 14.

Figure 14:
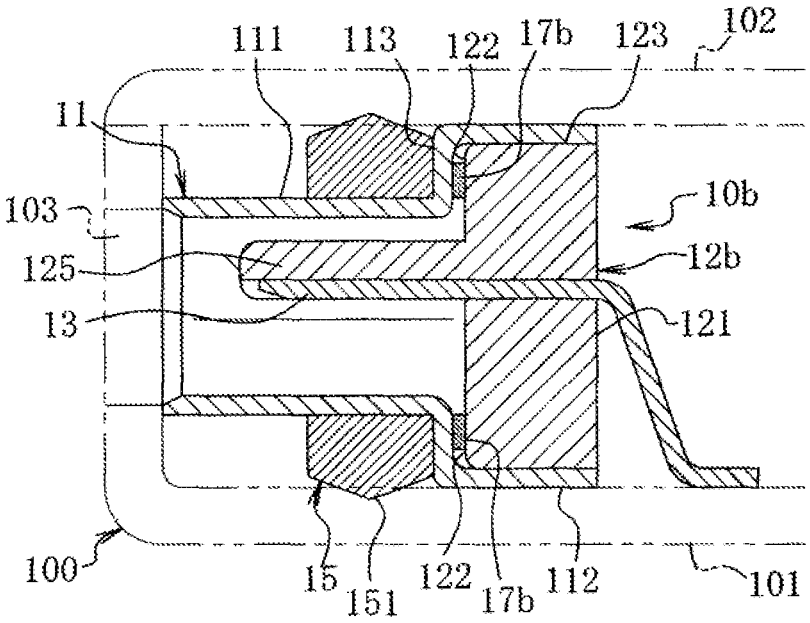
FIG. 14 is a sectional view corresponding to the view taken along line A-A, illustrating a second modification of the waterproof connection apparatus according to the first embodiment.

In the waterproof connection apparatus 10*b* illustrated in FIG. 14, a waterproof double-sided tape 17*b* as the circumferential sealing portion is provided on the front surface 122 of the supporting portion 12*b* instead of a configuration in which the recess 124 is formed on the outer circumferential side of the supporting portion 12 and the O-ring 14 is fitted to the recess 124. The waterproof double-sided tape 17*b* has one surface bonded to the front surface 122 of the supporting portion 12*b* in a circumferential form and the other surface bonded to the inner surface of the stepped portion 115 of the shell 11 corresponding to the outer case. This structure is formed by inserting the supporting portion 12*b* in which the waterproof double-sided tape 17*b* having the front surface configured as a bonding surface is provided on the front surface side into the shell 11 and bonding the front surface of the waterproof double-sided tape 17*b* to the inner surface of the stepped portion 115 of the shell 11 by bringing the front surface into contact with the inner surface. The other configurations are basically the same as those of the first embodiment.

In this example, since the waterproof double-sided tape 17*b* on the front surface side of the supporting portion 12*b* is inserted until the waterproof double-sided tape 17*b* abuts on the stepped portion 115 and is bonded to the stepped portion 115, it is possible to arrange the supporting portion 12*b* and the waterproof double-sided tape 17*b* at an accurate position in the shell 11 to realize waterproof and sealing properties. Therefore, it is possible to enhance the uniformity of products. Furthermore, since the waterproof double-sided tape 17*b* is used, it is possible to provide waterproof and sealing properties to the supporting portion 12*b* and the shell 11 of various shapes and sizes at a low cost and to enhance versatility. A circumferential sealing portion provided on a front surface side of the supporting portion 12*b* that can be bonded to the shell 11 is appropriate. For example, a configuration in which an elastic resin sealing portion integrated with the supporting portion 12*b* is provided so as to protrude toward the front surface side of the supporting portion 12*b* and has a front surface configured as a bonding surface so as to be bonded to the inner surface of the stepped portion 115 of the shell 11 may be used. Moreover, an appropriate surface positioned to face the front side of the supporting portion is included on the front surface side of the supporting portion in which the sealing portion is provided. The front surface 122 of the supporting portion 12*b* is included, and an inclined surface formed at a corner portion of the supporting portion and disposed on the front surface side of the supporting portion (for example, an inclined surface inclined so as to spread toward the rear side from a portion near the outer circumference of the front surface 122) is included. Furthermore, the same modification in which the circumferential sealing portion is provided on the front surface side of the supporting portion can be appropriately applied to the second and third embodiments.

Moreover, a circumferential sealing portion may be provided in advance on the outer case and the supporting portion may be inserted into the outer case so that the supporting portion is pressure-contacted or bonded to the circumferential sealing portion. For example, a circumferential O-ring may be fitted to a corner portion made up of the rear portion 113 and the stepped portion 115 of the shell 11, a supporting portion having a circumferential recess configured as a notch formed in a circumferential edge of the front surface thereof may be inserted into the shell 11, and the O-ring may be pressure-contacted to the inner surface of the rear portion 113 of the shell 11 in a protruding portion on the inner side of the recess so that the O-ring is fitted to the circumferential recess which is a notch having an L-shaped cross-section. Alternatively, a waterproof double-sided tape may be bonded to the inner surface of the stepped portion 115 of the shell 11 in a circumferential form, and in this state, the supporting portion is inserted into the shell 11 so that the front surface of the supporting portion is bonded to the waterproof double-sided tape in a circumferential form.

Industrial Applicability

The present invention is applicable as a waterproof connector used for electrical connection of various types of electronic equipment such as, for example, multifunctional mobile phones, multifunctional mobile information terminals, mobile audio players, or electronic book readers.

REFERENCE SIGNS LIST

10, 10*a*, 10*b*: Waterproof connection apparatus
11: Shell
111: Front portion
112: Rear portion
113: Stepped portion
12, 12*a*, 12*b*: Supporting portion
121: Body
122: Front surface
123: Outer circumferential surface
124: Recess
125: Protruding portion
13: Contact terminal
14: O-ring
15: Sealing member
151: Protruding strip
16*a*: Elastic resin sealing portion
17*b*: Waterproof double-sided tape

20: Waterproof connection apparatus
21: Case
211: Recessed groove
212: Rear portion
213: Stepped portion
22: Supporting portion
221: Body
222: Stepped portion
223: Front surface
224: Outer circumferential surface
225: Recess
226: Protruding portion
23: Contact terminal
24: O-ring
25: Sealing member
251: Protruding strip
26: Shell
30: Waterproof connection apparatus
31: Housing
311: Body
312: Front portion
313: Rear portion
314: Stepped surface
32: Supporting portion
321: Front surface
322: Outer circumferential surface
323: Recess
33: Contact terminal
331: Contacting terminal portion
332: Extension terminal portion
34: O-ring
100: Housing of electronic equipment
101: Housing body
102: Lid
103: Connecting tool insertion opening

The invention claimed is:

1. A waterproof connection apparatus for electronic equipment, comprising:

an approximately tubular outer case;

a supporting portion accommodated in a wall form on a deep side of the outer case;

a contact terminal supported by the supporting portion and introduced in the outer case;

a first circumferential sealing portion provided between the outer case and the supporting portion at a position at which the outer case and the supporting portion approach each other so as to seal a space between the outer case and the supporting portion; and a second circumferential sealing portion, provided outside of the outer case, so as to seal a space between the outer case and a housing, when the waterproof connection apparatus is inserted in the housing.

2. The waterproof connection apparatus for electronic equipment according to claim 1, wherein the first circumferential sealing portion is formed of an elastic material and is provided in the supporting portion, and the first circumferential sealing portion is pressure-contacted to an inner surface of the outer case in a circumferential form so that the supporting portion is press-fitted to the outer case.

3. The waterproof connection apparatus for electronic equipment according to claim 2, wherein the first circumferential sealing portion is provided in a state of press-fitting a protruding portion that protrudes outward from a portion of an outer circumferential surface of the supporting portion.

4. The waterproof connection apparatus for electronic equipment according to claim 2, wherein the first circumferential sealing portion is an O-ring and the O-ring is fitted to a stepped portion of the supporting portion at which the O-ring can be fixed stationary.

5. The waterproof connection apparatus for electronic equipment according to claim 3, wherein the first circumferential sealing portion is an O-ring and the O-ring is fitted to a stepped portion of the supporting portion at which the O-ring can be fixed stationary.

6. The waterproof connection apparatus for electronic equipment according to claim 2, wherein the first circumferential sealing portion is formed of an elastic resin that is integrated with the supporting portion.

7. The waterproof connection apparatus for electronic equipment according to claim 3, wherein the first circumferential sealing portion is formed of an elastic resin that is integrated with the supporting portion.

8. The waterproof connection apparatus for electronic equipment according to claim 2, wherein the outer case is formed of metal.

9. The waterproof connection apparatus for electronic equipment according to claim 3, wherein the outer case is formed of metal.

10. The waterproof connection apparatus for electronic equipment according to claim 4, wherein the outer case is formed of metal.

11. The waterproof connection apparatus for electronic equipment according to claim 5, wherein the outer case is formed of metal.

12. The waterproof connection apparatus for electronic equipment according to claim 6, wherein the outer case is formed of metal.

13. The waterproof connection apparatus for electronic equipment according to claim 7, wherein the outer case is formed of metal.

14. The waterproof connection apparatus for electronic equipment according to claim 1, wherein the first circumferential sealing portion is provided on a front surface side of the supporting portion and is bonded to a stepped portion of the outer case in a circumferential form.

15. The waterproof connection apparatus for electronic equipment according to claim 14, wherein the first circumferential sealing portion is a waterproof double-sided tape having one surface bonded to the front surface side of the supporting portion and the other surface bonded to the stepped portion of the outer case.

16. Electronic equipment comprising the waterproof connection apparatus for electronic equipment according to claim 1 accommodated in the housing.

17. Electronic equipment comprising the waterproof connection apparatus for electronic equipment according to claim 2 accommodated in the housing.

18. Electronic equipment comprising the waterproof connection apparatus for electronic equipment according to claim 3 accommodated in the housing.

19. Electronic equipment comprising the waterproof connection apparatus for electronic equipment according to claim 4 accommodated in the housing.

20. Electronic equipment comprising the waterproof connection apparatus for electronic equipment according to claim 6 accommodated in the housing.

21. The waterproof connection apparatus for electronic equipment according to claim 1, wherein the supporting portion includes a protruding portion which supports the contact terminal, and wherein the contact terminal penetrates through the supporting portion.

22. The waterproof connection apparatus for electronic equipment according to claim 1, wherein the first circumferential sealing portion is in contact with the outer case and the supporting portion.

* * * * *